US005959868A

United States Patent [19]

Oppliger et al.

[11] Patent Number: 5,959,868

[45] Date of Patent: Sep. 28, 1999

[54] ARRANGEMENT FOR DISTRIBUTING ARTICLES FOR DISPATCH

[75] Inventors: Jean-Claude Oppliger, Niederhasli, Switzerland; Manfred Boller, Hohentengen, Germany

[73] Assignee: Grapha-Holding AG, Hergiswil, Switzerland

[21] Appl. No.: 08/836,600

[22] PCT Filed: Sep. 4, 1996

[86] PCT No.: PCT/CH96/00301

§ 371 Date: May 2, 1997

§ 102(e) Date: May 2, 1997

[87] PCT Pub. No.: WO97/09132

PCT Pub. Date: Mar. 13, 1997

[30] Foreign Application Priority Data

Sep. 8, 1995 [CH] Switzerland ..... 2551/95

[51] Int. Cl.[6] ..... B07C 17/00

[52] U.S. Cl. ..... 364/478.14; 364/478.03; 198/349.6; 198/468.6; 414/584; 414/900; 209/609

[58] Field of Search ..... 198/349.6, 465.1, 198/468.6, 468.8; 364/478.18, 478.03, 478.14; 209/942, 583, 584, 900, 3.3, 702; 414/609, 280, 268

[56] References Cited

U.S. PATENT DOCUMENTS

| | | | |
|---|---|---|---|
| 2,983,392 | 5/1961 | Ebbert | 414/276 |
| 3,782,565 | 1/1974 | Doran et al. | 214/16.4 |
| 3,884,370 | 5/1975 | Bradshaw et al. | 209/900 |
| 4,503,977 | 3/1985 | Kohno et al. | 209/584 |
| 4,756,657 | 7/1988 | Kinney | 414/280 |
| 4,773,807 | 9/1988 | Kroll et al. | 414/280 |
| 5,090,552 | 2/1992 | Fukuyama et al. | 198/365 |
| 5,190,162 | 3/1993 | Hartlepp | 209/583 |
| 5,293,893 | 3/1994 | Grapes et al. | 209/900 |
| 5,379,229 | 1/1995 | Parsons et al. | 364/478.18 |
| 5,385,243 | 1/1995 | Jackson et al. . | |
| 5,405,232 | 4/1995 | Lloyd et al. | 414/280 |
| 5,419,457 | 5/1995 | Ross et al. | 209/584 |
| 5,535,874 | 7/1996 | Ross et al. | 209/900 |
| 5,538,140 | 7/1996 | Guenther et al. | 209/583 |
| 5,551,576 | 9/1996 | Importico | 209/908 |
| 5,553,988 | 9/1996 | Horn et al. | 198/465.1 |

FOREIGN PATENT DOCUMENTS

| | | |
|---|---|---|
| 0521394 | 1/1993 | European Pat. Off. . |
| 0640409 | 3/1995 | European Pat. Off. . |
| 2676941 | 12/1992 | France . |

*Primary Examiner*—William E. Terrell
*Assistant Examiner*—Khoi H. Tran
*Attorney, Agent, or Firm*—Venable; George H. Spencer; Catherine M. Voorhees

[57] ABSTRACT

In order to increase the efficiency of an arrangement for distributing articles for dispatch with a distributing conveyor, a transfer device is proposed. The distributing conveyor is used to deliver the articles for dispatch to collecting containers that are arranged at delivery locations along a conveying route of the distributing conveyor. The transfer device responds to transfer signals emitted by a control device that respectively designate a delivery location of a collecting container, and is used for transferring the collecting containers between the delivery locations and a predetermined transporting route for the collecting containers.

24 Claims, 5 Drawing Sheets

ARRANGEMENT FOR DISTRIBUTING ARTICLES FOR DISPATCH

BACKGROUND OF THE INVENTION

The invention concerns an arrangement for distributing articles for dispatch with a distributing conveyor, which is used to convey the articles for dispatch one after another along a conveying route and transfer them to collecting containers that are provided at delivery locations along the conveying route, and which has a control device that determines the delivery locations for the articles for dispatch.

Arrangements of this type are used, for example, in post offices for sorting articles for dispatch according to delivery districts. For this, the distributing conveyor generally has a number of conveying bins, respectively holding one article for dispatch, which can be conveyed one after another along a conveying loop and from which the articles for dispatch can be dropped into collecting containers. Articles for dispatch that are intended for one delivery district respectively are collected in the collecting containers. The dispatch addresses for the individual articles for dispatch as well as the assignment between the articles for dispatch and the conveying bins are detected by the control device in order to control the dropping of the articles for dispatch from the conveying bins. In this case, the addresses can be detected automatically by means of a scanner or through a manual input. As described above, the known arrangement can be operated automatically with few personnel. But, any further distribution of the articles for dispatch delivered to the collecting containers requires a relatively high number of personnel.

SUMMARY OF THE INVENTION

In view of this problem, it is an object of the invention to provide an arrangement that permits a further automation of the distribution of articles for dispatch by making use of known automatic distributing conveyors.

The solution according to the invention is with an arrangement of the aforementioned type, which is essentially characterized by a device responding to transfer signals transmitted by the control device that respectively designate one of the delivery locations, means for selectively transferring of the collecting containers between the delivery locations when the selective transfer is designated by the transfer signals and a transport route for the collecting containers.

Thus, with the inventive arrangement for distributing articles for dispatch, the control device not only controls the delivery of the articles for dispatch to the collecting containers, but also the continued transport of the articles for dispatch that have already been delivered to the collecting containers. The transfer device responding to respective transfer signals from the control device is used for this. Consequently, the number of service personnel needed to operate the inventive arrangement is reduced as compared to the number of service personnel needed to operate the traditional arrangements for distributing articles for dispatch, because the collecting containers to be removed no longer have to be determined by respective service personnel and removed from the respective delivery locations, but are automatically detected by the control device and are readied for removal by the transfer device that responds to the transfer signals.

Furthermore, the transfer device for the inventive arrangement can also be used for the automatic feeding of the distributing conveyor with collecting containers.

It is advantageous if for the transfer of the collecting containers set up a spatially separate delivery locations, a transfer device is used which can be moved along a movement path that leads to the delivery locations. As a result of this, only one transfer device is needed to remove all collecting containers set up at the delivery locations.

When operating the movable transfer device, it is possible to achieve an exact positioning of the transfer device with respect to the delivery locations where the collecting containers that are to be removed are located, and thus an increase in the operating reliability when transferring the collecting containers, if the movement route extends at least along a portion of the conveying route. For this, the transfer device can be guided by a rail that runs along at least a section of the conveying route.

A further automation of the inventive arrangement can be achieved if the transferred collecting containers are transported off with a transporting device that conveys them along the transporting route.

The design for this transporting device can be particularly simple if it has a belt conveyor running at least along a section of the conveying route.

Even though a high degree of automation can already be achieved with the transfer device described above, it is particularly advisable in order to save additional operating costs to use the transfer device not only for transporting the transporting containers from the delivery locations to the removal locations, but also for replacing the collecting containers arranged at the delivery locations designated by the transfer signals with collecting containers that are on the transporting route. As a result of this, the full operating capacity of the distributing conveyor can be used almost constantly because a collecting container is always ready at any point in time at all delivery locations, with the exception of the time needed for replacement.

It is useful if empty collecting containers for replacement can be supplied to the transfer device along the transporting route. It is advantageous if these are also supplied by the transfer device used to remove the transferred collecting containers.

An increase in the replacement speed can be achieved if the transporting device is provided with at least two independently operating transporting elements, preferably adjoining conveyor belts, for supplying the empty collecting containers independent of the removal of the collecting containers that have been transported to the removal location for removal. As a result of this, it can be achieved that even if a transporting element of the automatic transporting device, to which a collecting container must be transferred is standing still to ensure a safe transfer, an empty collecting container can simultaneously be supplied with another transporting element as replacement for the collecting container to be transferred.

The transfer of the collecting containers can be particularly simple if they can be moved horizontally by the transfer device. For this, the transfer device advantageously has a gripper for the collecting containers that functions to move the collecting containers in horizontal direction while moving crosswise to the conveying direction of the distributing conveyor, and which can preferably be placed against one edge of the collecting container. In this way, the transfer device can be moved along the conveying route without obstructing the delivery of the articles for dispatch, if the gripper was moved crosswise to the conveying direction to a resting position, whereas it can be placed against the collecting containers set up at the delivery locations for their transfer by moving it in the opposite direction, that is crosswise to the conveying direction. The gripper can be designed particularly simple if it can be moved in a horizontal plane, perpendicular to the conveying direction of the distributing conveyor at the delivery locations.

A faster replacement of the collecting containers to be transported to the removal location can be achieved if the transfer device for replacing the collecting containers has two grippers that can each be moved crosswise to the transporting a direction and are arranged such that they are displaced against each other in conveying direction of the distributing conveyor. With this arrangement, one gripper can be used for transferring the collecting containers to be removed while the other gripper simultaneously can be used to supply an empty collecting container to the respective delivery location, so that the replacement time is minimized.

If the delivery locations are arranged above and/or below the removal locations, it is necessary that the collecting containers be moved vertically by the transfer device. In order to ensure a particularly safe transfer, the transfer device here has a holding element for the vertical support of the collecting containers, which element can be moved advantageously in vertical direction.

In order to minimize the time needed for replacing the collecting containers, it is furthermore particularly useful if the transfer device has two holding elements for one each collecting container that are arranged displaced against each other and can be moved in vertical direction.

The holding elements, which simultaneously permit the removal of the transferred collecting containers with the automatic transporting device, can be constructed particularly easy if they are adjustable between a contact position at the collecting container and a release position, designed to release the collecting containers.

Such holding elements can be designed simply if they can be placed in the contact position against an underside of a holding rail running along the container outside.

It is particularly advantageous if the collecting containers can be moved during the transfer in horizontal as well as in vertical direction. It is advisable in this case if they are delivered to the holding element by the gripper, which can move in horizontal direction. In a similar way, the empty collecting containers that are intended for replacing the transferred collecting containers are transferred from the holding element to the gripper.

For reasons of space, it is particularly useful if the delivery locations are arranged in at least two horizontal planes. The removal of the transferred collecting containers is particularly simple if a joint transporting route is specified for two collecting containers arranged at delivery locations provided in different horizontal planes.

A particularly high operating reliability can be achieved with the inventive device if the control device has a mechanism for determining the filling level of the collecting containers arranged at the delivery locations and if it emits a transfer signal for the collecting containers once the filling level exceeds a predetermined threshold value. This is a reliable way to prevent an overflowing of the collecting containers, which would lead to interruptions in the distributing conveyor operation.

The filling level of the collecting containers can be detected without further design expenditure if the determination device detects the number and/or the space requirement for the articles for dispatch that are delivered to the individual collecting containers. As a result of this, the filling level of all collecting containers can be detected purely electronically at the delivery locations, without using corresponding sensors.

For a safe removal of the collecting containers, for example to the various delivery districts, the collecting containers that have been transferred by the delivery locations onto the conveying route are provided with an identification that identifies the respective delivery location.

The variability of the inventive arrangement is increased in that it has a device for affixing the identification to the collecting containers, which device is preferably attached to the transfer device. This ensures that any of the containers basically can be set up at any of the delivery locations and that the identification is only affixed while the containers are being set up or after they have been set up. Thus, no storage is required for the collecting containers provided with varied identifications.

The identification can be affixed in a very simple manner to the collecting containers if these have been provided with a digital storage medium for this, for example a recordable memory chip that carries the identification.

As already described, it is useful if the distributing conveyor has a number of conveying elements, circulating along a conveying loop one after another that respectively serve to convey and deliver an article for dispatch, preferably conveying bins, from which the articles for dispatch can be dropped at the delivery locations.

BRIEF DESCRIPTION OF THE DRAWINGS

The invention is described in the following by referring to the drawings, to which we also refer with respect to all details that are essential to the invention and are not discussed further in the description.

Shown in the drawings are.

DETAILED DESCRIPTION OF THE INVENTION

Figure 1A:
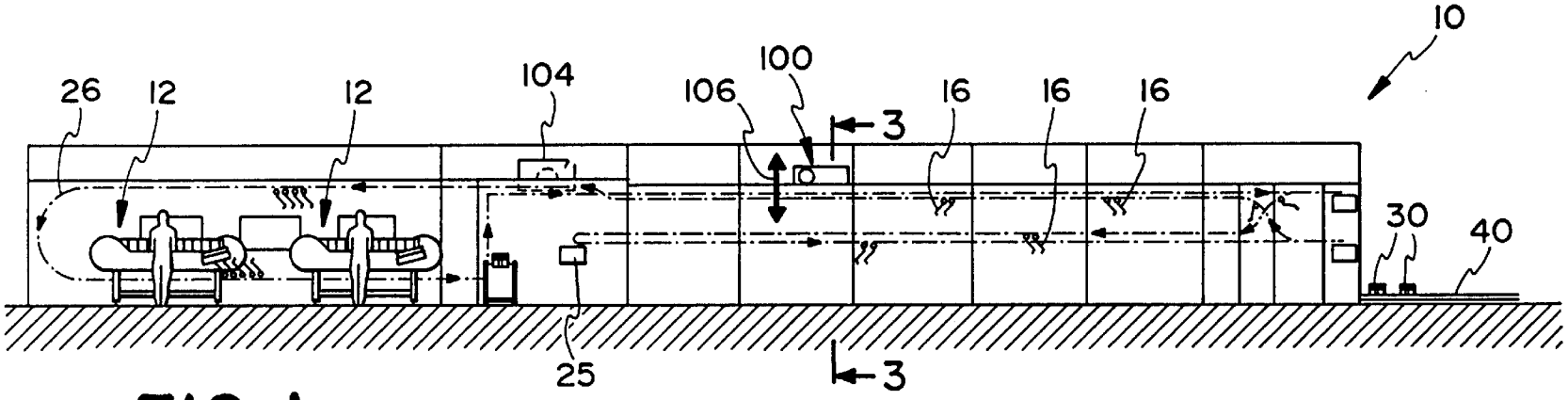
FIG. 1*a*) is a view from the side of an inventive arrangement.
Figure 1B:
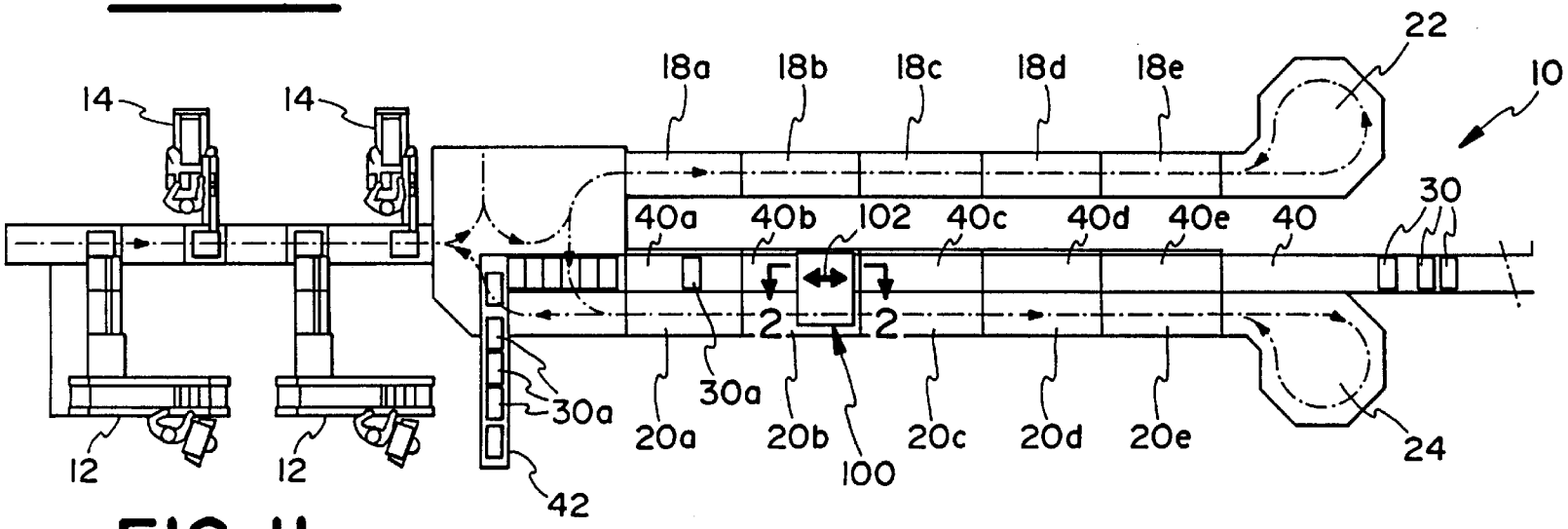
FIG. 1*b*) is a view from above of the arrangement according to FIG. 1*a*)

The arrangement shown in the drawing figures has a distributing conveyor 10 for transferring individual articles for dispatch to collecting containers 30, as well as a device 100 for the selective transfer of the collecting containers between a delivery location where the articles for dispatch are transferred to the collecting containers 30 and a predetermined transporting route for the collecting containers. The distributing conveyor 10 has a number of conveying bins 16 that circulate one after another along a conveying loop and are respectively designed to convey an article for dispatch. These conveying bins 16 are supplied with the articles for dispatch by feeding stations 12 and 14, arranged along the conveying loop. In this case, the addresses on the individual articles for dispatch are detected automatically by scanners at the feeding stations 12 and are forwarded to a control device (not shown). At the feeding stations 14, the dispatch addresses on the individual articles for dispatch are input manually and forwarded to the control device. In addition to the dispatch addresses for the individual articles for dispatch, the control device detects the assignment between the articles for dispatch and the conveying bins, which are supplied with them.

After leaving the feeding stations, the conveying bins are lifted during the course of the conveying loop to an upper horizontal plane and there pass a number of delivery modules 18*a* to 18*e*. The delivery modules 18*a* to 18*e* each have four collecting containers for the articles for dispatch in the upper horizontal plane, which containers are set up at the corresponding delivery locations. After passing through a reversing module 22, the conveying bins are then lowered during the further course of the conveying loop to a lower horizontal plane, where they initially pass once more through the delivery modules 18*e* to 18*a*, but in the reverse sequence. In the lower horizontal plane as well, each of the delivery modules 18*a* to 18*e* has respectively four collecting containers set up at corresponding delivery locations. After passing by another reversing module 25, the conveying bins then pass in the lower horizontal plane through delivery modules 20*a* to 20*e*, which again have four collecting containers each, set up at the respective delivery locations in the lower horizontal plane. Subsequently, the conveying bins pass by another reversing module 24 and are moved along the conveying loop once more to the upper horizontal plane, where they pass again through the delivery modules 20*e* to 20*a*, but in the reverse sequence. Each of the delivery modules 20*a* to 20*e* in the upper horizontal plane also has respectively four collecting containers, set up at the corresponding delivery locations. Finally, after passing through a vertical curve 26, the conveying bins arrive again at the feeding stations 12 and 14.

Each of the collecting containers set up at the delivery locations is used to collect the articles for dispatch for one delivery district respectively. For the collecting, the articles for dispatch that are transported in the conveying bins are dropped at the respective delivery location into the collecting container set up there after responding to a control signal emitted by the control device, which identifies the respective delivery district predetermined by the dispatch address. In this case, the control device determines the number of articles for dispatch dropped into the respective collecting container. If the number of articles for dispatch dropped into one of the collecting containers set up at the delivery locations exceeds a predetermined threshold value, then the respective collecting container must be replaced with an empty collecting container. This is done manually at the delivery modules 18*a* to 18*e*. At the delivery modules 20*a* to 20*e*, however, an automatic transfer device 100 is used for this.

This transfer device 100 can be moved along a movement route that passes by the delivery modules 20*a* to 20*e*, as indicated by the double arrow 102, and is used to transfer the collecting containers 30 that are arranged at the delivery locations to a belt conveyor 40 that runs along the delivery modules 20*a* to 20*e*. The control device emits transfer signals, which designate the delivery locations where collecting containers 30 are set up, and into which a number of articles for dispatch exceeding the predetermined threshold value were dropped. The automatic transfer device 100 by responding to these transfer signals is automatically moved to the respective delivery location and transfers the collecting container set up there to the belt conveyor 40, which is then used to remove the collecting container 30. Furthermore, empty collecting containers 30*a* can be supplied with the belt conveyor 40 to the transfer device 100, which are designed to replace the removed collecting containers 30.

For a quick and reliable replacement of the collecting containers designated by the transfer signal, the belt conveyor 40 that responds to respective control signals emitted by the control device, has conveying belts 40*a* to 40*e*, which can be operated independently and are respectively assigned to one of the delivery modules 20*a* to 20*e*. In this way, while the conveyor belt 40*b* is standing still in the position for the transfer device 100 that is shown in FIGS. 1*a*) and *b*) is designed to ensure a reliable transfer of the collecting container designated by the transfer signal, an empty collecting container 30*a*, supplied to the belt conveyor 40 by means of a feeder 42, can be brought closer to the transfer device 100.

The exact configuration of the transfer device 100 is explained in the following with the aid of FIGS. 2 to 5. As follows in particular from the FIG. 3, the transfer device 100 is supported by a slide rail 124 that is installed on a frame 11 of the distributing conveyor 10. In order to move it along the delivery modules 20*a* to 20*e* by means of a motor 104 that is coupled with the transfer device 100, the transfer device 100 has rollers 125 that make contact with the slide rail 124. For securing the transfer device 100, a holding rail 123 is mounted in the lower region of the distributing conveyor frame 11, which functions as guide for the rollers 122 that are fixed to transfer device 100.

Figure 2:
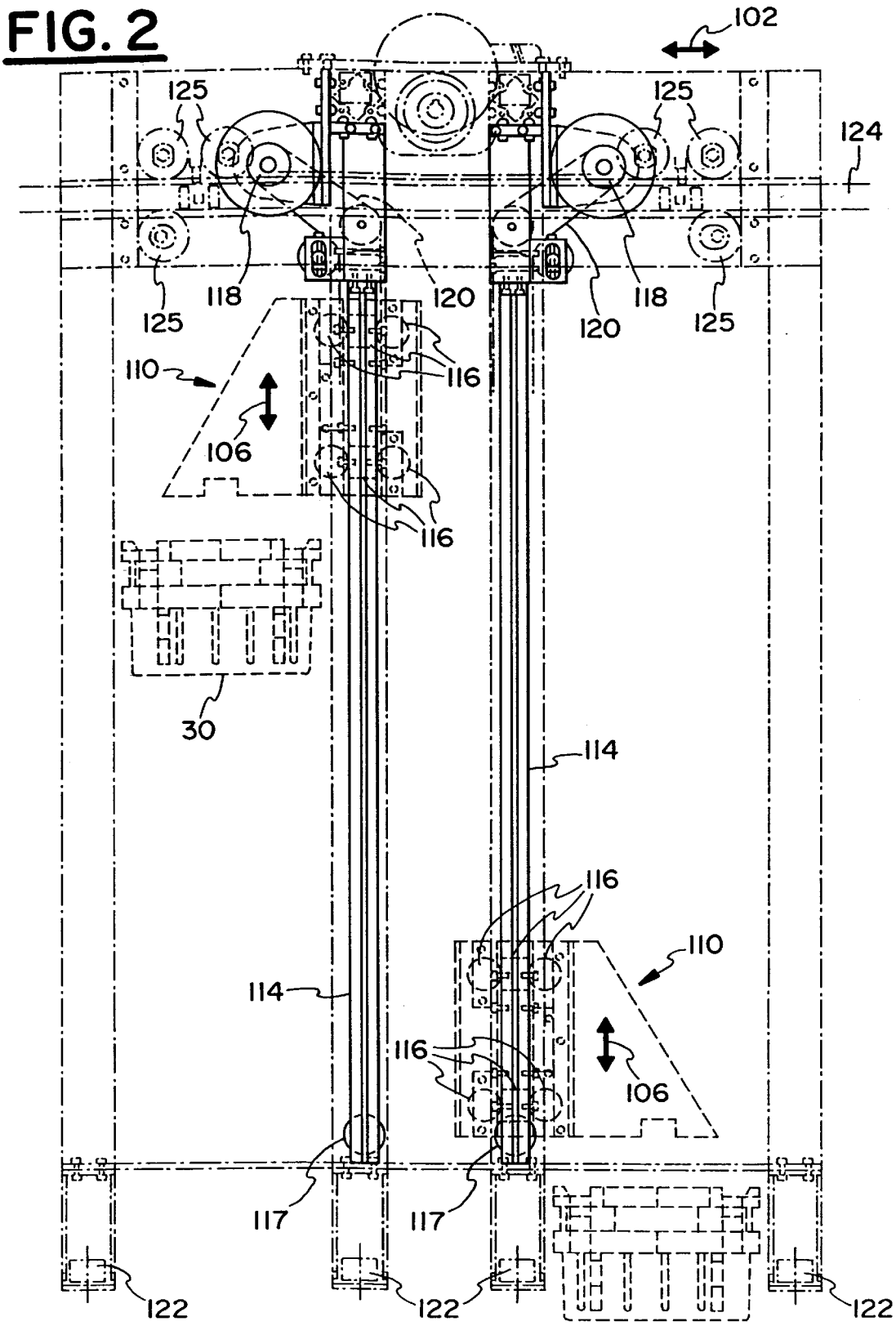
FIG. 2 is a sectional view of the arrangement according to FIG. 1, along the plane 2—2 shown in FIG. 1*b*)
Figure 3:
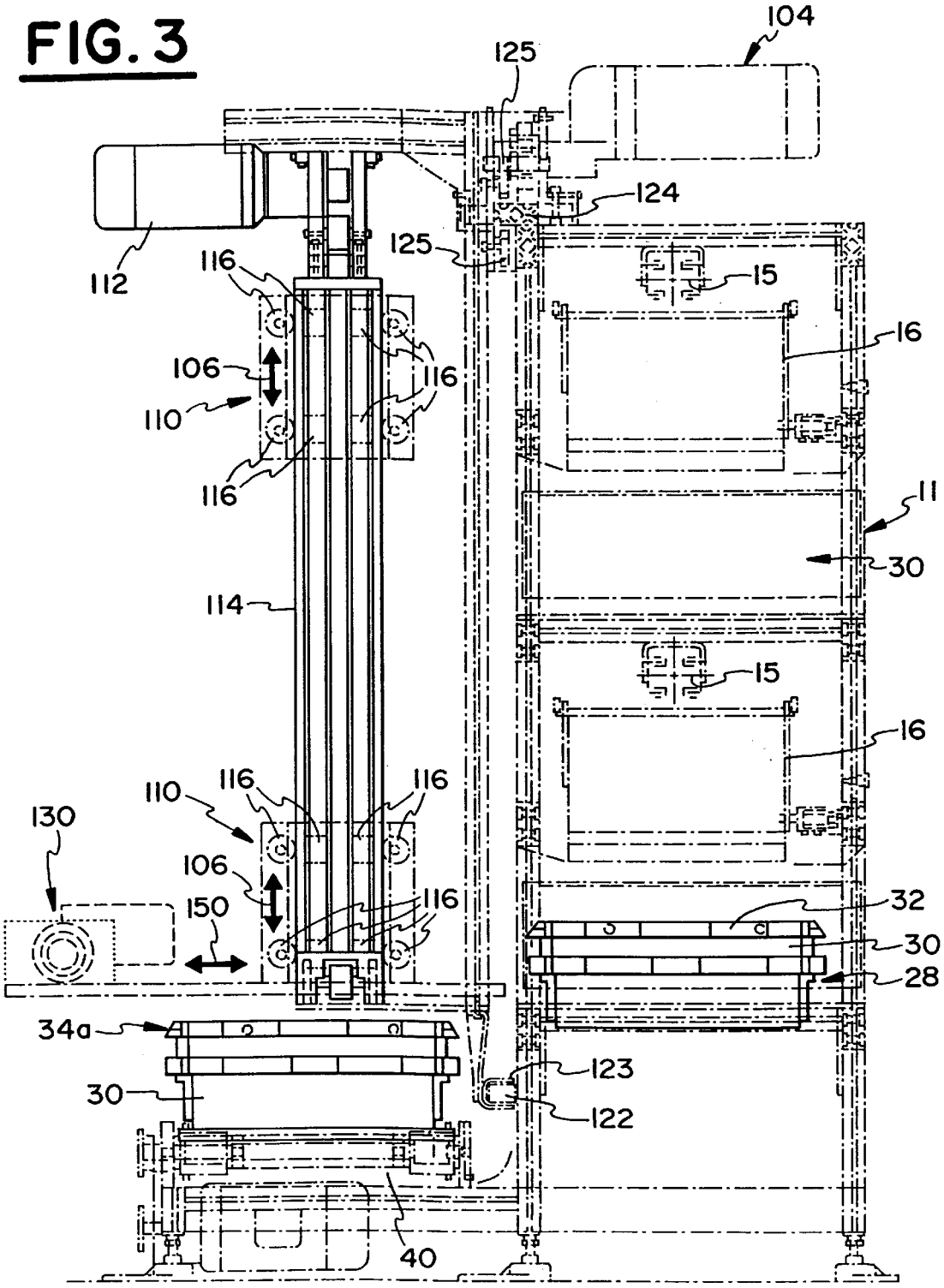
FIG. 3 is a sectional view of the arrangement according to FIG. 1, along the plane 3—3 shown in FIG. 1*a*)

As is particularly clear in FIG. 2, the transfer device 100 has two transporters 110, which are displaced against each other indicated by double arrows 106, in a conveying direction of the belt conveyor, can be moved in a vertical direction and respectively function to transfer a collecting container. These transporters 110 are respectively coupled to a traction element 120 that circulates around a deflection roller 117 as well as a drive roller 118 and can thus be moved along guide rails 114 in the vertical direction 106 by means of a motor 112 that is coupled to the drive rollers 118. The transporters 110 in this case are guided by attached guide rollers 116 that make contact with the vertical rails 114.

In order to transfer the collecting containers 30 (compare FIG. 3) set up at delivery locations 28, which are arranged one above the other in two horizontal planes, each transporter 110 has a displacement element 130, with which the collecting containers 30 can be removed horizontally from the delivery locations 28, as is indicated by the double arrow 150. The collecting containers 30 thus removed are then moved in vertical direction with the transporters 110 for transferring them to the belt conveyor 40. While the collecting containers designated by the transfer signal are transferred in this way at the delivery location by one of the transporters to the transporting route, the other transporter 110 can simultaneously be used to replace the transferred collecting container with an empty collecting container, supplied along the transporting route.

Figure 4:
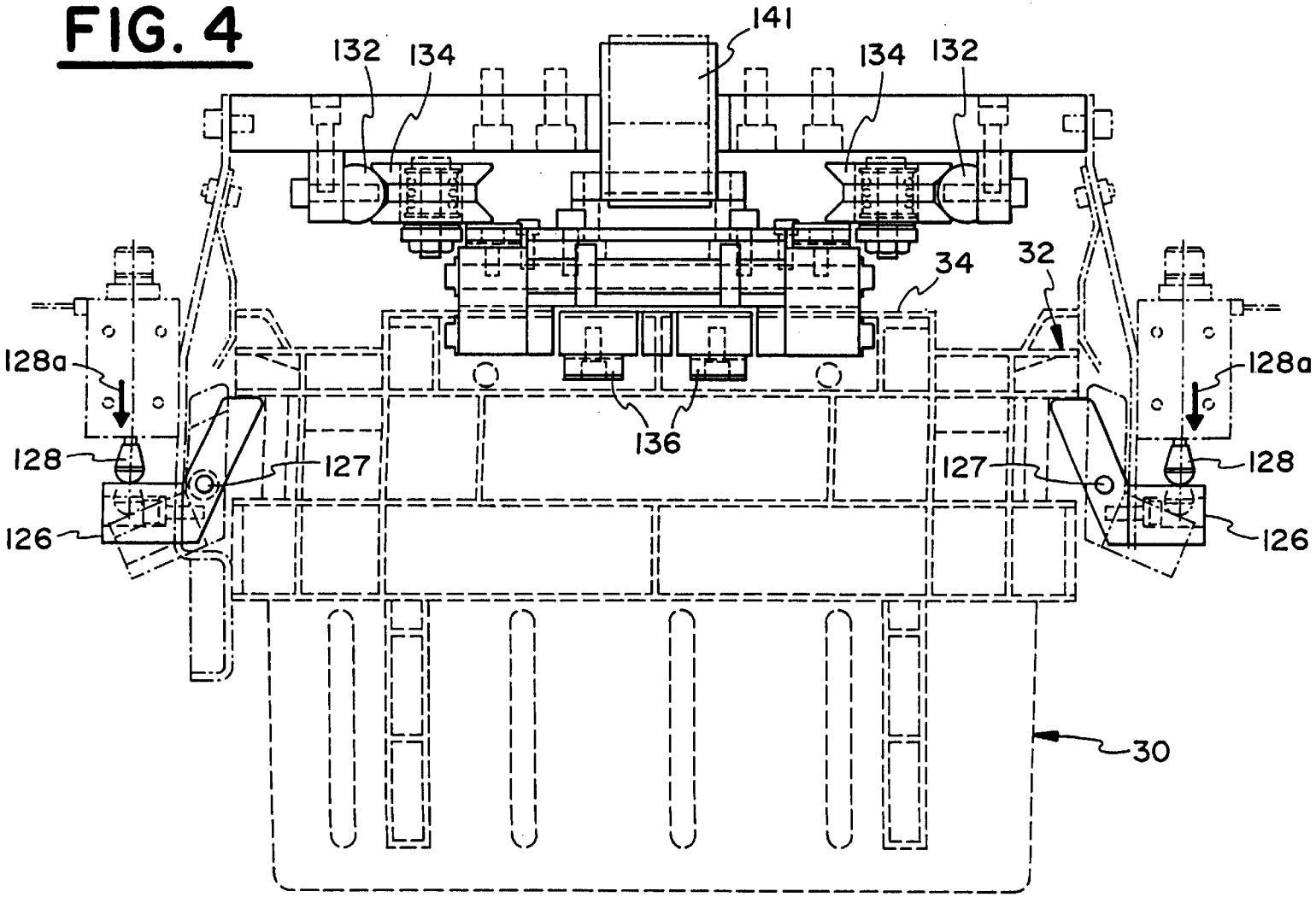
FIG. 4 an enlarged sectional view of a portion of the arrangement shown in FIG. 2.

As is particularly clear from FIG. 4, the transporter 110 has two holding elements 126 for securing the collecting containers 30 during the transport in the vertical direction. In the position shown in FIG. 4 with a continuous line, the holding elements 126 fit against the underside of a holding strip 32 that is arranged on the outside of container 30. In order to release the collecting containers 30, the holding elements 126 can be switched to a release position, which is indicated in FIG. 4 with a dash-dot line. For this, a slide tappet 128 that makes contact with the upper side of a leg of the holding element 126 is moved in the direction designated by the arrow 128*a*, so that the holding elements 126 are swiveled around the axis 127. In this position of the holding elements 126, the transporters 110 can be moved in a vertical direction while avoiding a carrying along of the collecting containers 30. The collecting container 30, which is released in this way and is transferred to the transporting route, can then be removed with the belt conveyor 40.

Figure 5:
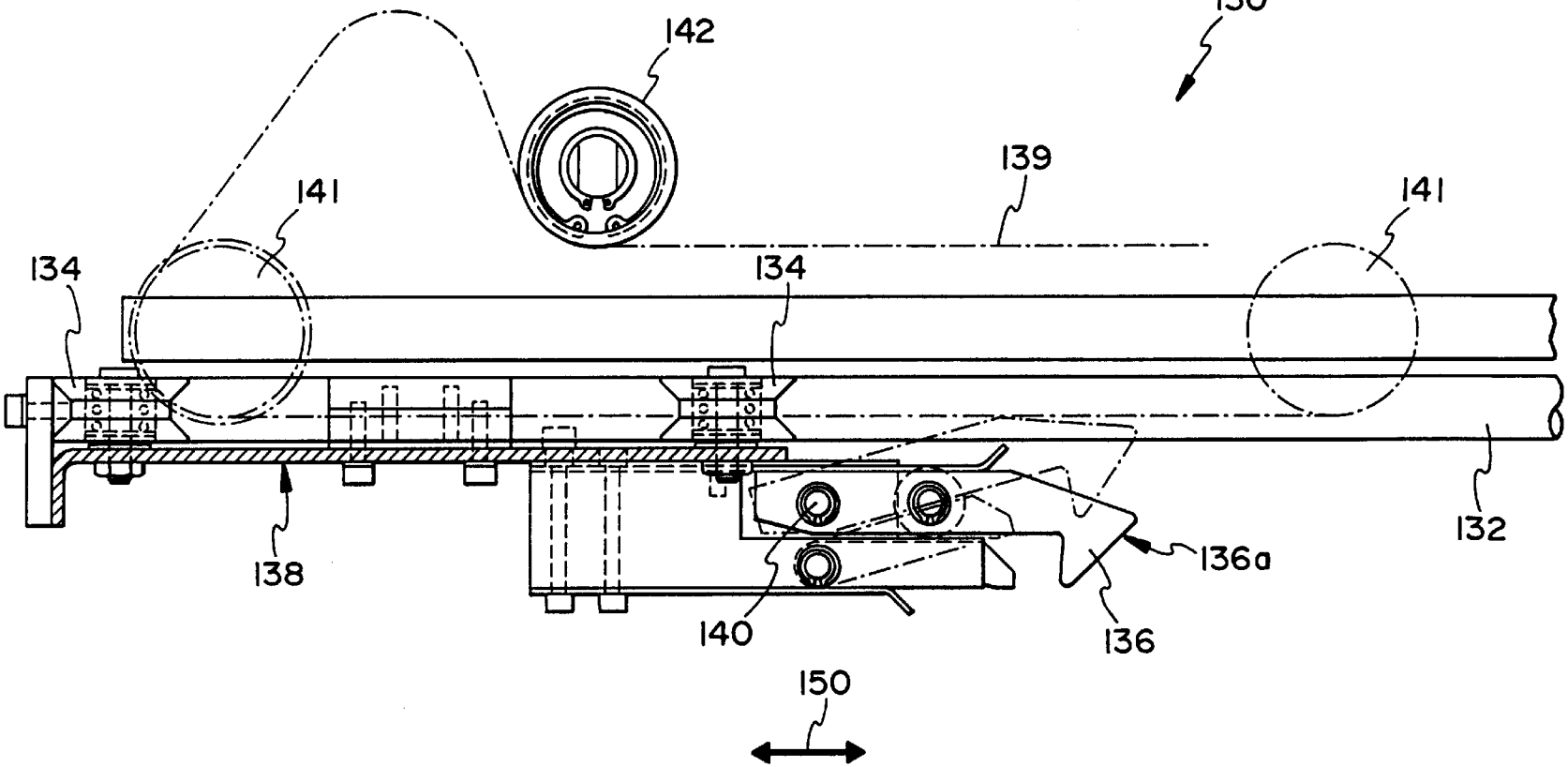
FIG. 5 an enlarged sectional view of a portion of the arrangement shown in FIG. 3.

In accordance with FIG. 5, the displacement element 130, used to remove the transporting containers 30 at the delivery locations 28 as well as to supply empty collecting containers 30*a* to the delivery locations 28, has a carriage 138, which can be moved in a horizontal plane, perpendicular to the conveying direction of the conveying bins 16 that are attached to a conveying chain 15. Mounted on the carriage are on the one hand grippers 136 that pivot around an axis 140 and are designed to grip an edge element 34 (see FIG. 4) of the collecting containers 30. On the other hand, the cart 138 is fixed to a traction element 139 that circulates around deflection rollers 140 as well as a drive roller 142. With the aid of this traction element, the carriage can be moved in the direction designated by the double arrow 150. The carriage is here guided along horizontal rails 132 with guide rollers 134 that are attached to it.

In order to automatically grip an edge element 34 of the collecting containers 30 that extends in the conveying direction of the distributing conveyor 10, the gripper 136 has a sliding surface 136*a* on its front that extends at a slant upward. A corresponding, upward-slanted sliding surface 34*a* is also provided on the outside of edge element 34 (compare FIG. 3). For gripping the collecting containers that are set up at the delivery locations 28, the carriage 138 is moved to the right in the illustration according to FIGS. 3 and 5. The sliding surface 136*a* of the gripper 136 here slides automatically upward, along the sliding surface 34*a*of the edge element 34. As a result of this, the gripper 136 is automatically swiveled around the axis 140 and thus is placed in the position shown in FIG. 5 with dash-dot line. After passing the edge element 34 and at the same time gripping the edge element, the gripper 136 then returns to its original position. In this position, the container 30 to be transferred can be removed from the delivery location 28 in that the carriage 138 is moved to the left, as shown in the illustration in FIGS. 3 and 5. It is then automatically transferred by the gripper 136 to the holding elements 126, which at this point are in the contact position where they make contact with the underside of the holding strip 32. Thus secured by the holding elements 126, the collecting containers 30 can subsequently be transferred to and placed on the belt conveyor 40 through the vertical movement of the transporters 110. After placing the holding elements 126 into the release position, the collecting containers 30 subsequently can be released by lifting up the transporters 110. It is not necessary to activate the grippers 136 for this. It means that no separate activation means for the grippers 136 is necessary to operate the above explained arrangement of the transporters 110, as a result of which the total design for the transfer device 100 is simplified.

The operation of the above explained transfer device 100 and the belt conveyor 40 is controlled by the control device. For this, the control device detects the number of articles for dispatch dropped into the individual collecting containers 30 and forwards corresponding transfer signals to the transfer device 100. It can also be planned to detect the space requirement for the individual articles for dispatch at the feeding stations 12 and 14, and to determine the filling level of the containers in dependence on the number of and the space requirement for the articles for dispatch dropped into the individual collecting containers 30. It is furthermore planned to arrange a device on the transfer device 100, which makes it possible to provide an identification for the collecting containers 30 that are removed at the delivery locations 28 or that are supplied to the delivery locations, which identifies the respective delivery location. In particular, it is planned in this case to provide the containers 30 with a recordable memory chip, thus allowing a simple reuse of the collecting containers. The belt conveyor 40 can be controlled such that already transferred collecting containers can be removed with the individual conveying belts 40*a* to 40*e* while, at the same time, empty collecting containers can be supplied and a conveying belt onto which a collecting container is to be transferred at that moment is standing still.

We claim:

1. An arrangement for distributing articles for dispatch comprising:

a distributing conveyor that conveys articles for dispatch one after another along a conveying route;

collecting containers that are arranged at delivery locations along the conveying route, said distributing conveyor transferring articles for dispatch to the collecting containers;

a control device determining the respective delivery locations for the articles for dispatch and emitting transfer signals that identify the respective delivery locations; and a transfer device movable along a movement route that leads to the delivery locations and responding to the transfer signals emitted by the control device in order to automatically and selectively transfer collecting containers between the delivery locations designated by the transfer signals and a predetermined transporting route for the collecting containers.

2. An arrangement according to claim 1, characterized in wherein the movement route extends at least along a segment of the conveying route.

3. An arrangement according to claim 1, further comprising a transporting device that conveys the transferred collecting containers along the transporting route.

4. An arrangement according to claim 3, wherein the transporting device has a belt conveyor that runs at least along a segment of the conveying route.

5. An arrangement according to claim 1, wherein at the delivery locations designated by the transfer signals, the transfer device is operated so as to replace the collecting containers with articles of dispatch with empty collecting containers on the transporting route.

6. An arrangement according to claim 5, wherein empty collecting containers are supplied as replacement containers to the transfer device along the transporting route.

7. An arrangement according to claim 6, wherein empty collecting containers are supplied via an automatic transporting device.

8. An arrangement according to claim 7, wherein the automatic transporting device has two transporting elements which can be operated independently.

9. An arrangement according to claim 1, wherein the collecting containers are horizontally moved by the transfer device.

10. An arrangement according to claim 9, wherein the transfer device has a gripper for the collecting containers which is movable crosswise to a conveying direction of the distributing conveyor, is used for the horizontal movement of the collecting containers and is placed against one edge of the collecting containers.

11. An arrangement according to claim 10, wherein the gripper can be moved at the delivery locations in a horizontal plane, perpendicular to the conveying direction of the distributing conveyor.

12. An arrangement according to claim 10, wherein the transfer device has two grippers, which are arranged displaced against each other in a conveying direction of the distributing conveyor and can be moved respectively crosswise to the conveying direction.

13. An arrangement according to claim 1, wherein the collecting containers can be moved in vertical direction by the transfer device.

14. An arrangement according to claim 13, wherein the transfer device has a holding element that can be moved in a vertical direction and functions to vertically support the collecting containers.

15. An arrangement according to claim 14, wherein the transfer device has two holding elements for each one collecting container, which are displaced against each other in a conveying direction of the distributing conveyor and can be moved in vertical direction.

16. An arrangement according to claim 14, wherein the holding element can be switched between a contact position at the collecting container that serves the vertical movement of the collecting container and a release position that is designed for the release of the collecting container.

17. An arrangement according to claim 16, wherein the holding element in the contact position can be placed against an underside of a holding strip that extends on an outside of the collecting container.

18. An arrangement according to claim 10, wherein the transfer device further has a holding element that can be moved in a vertical direction and functions to vertically support the collecting containers, and for the transfer operation, the collecting containers are transferred from at least one of the gripper to the holding element and the holding element to the gripper.

19. An arrangement according to claim 1, wherein the delivery locations are provided in at least two horizontal planes.

20. An arrangement according to claim 19, wherein a joint transporting route is specified for two collecting containers that are arranged at delivery locations in different horizontal planes.

21. An arrangement according to claim 1, wherein the collecting containers that have been transferred from the delivery locations to the transporting route are provided with an identification that identifies the respective delivery location.

22. An arrangement according to claim 1, wherein the distributing conveyor has a number of conveying elements that circulate one after another along a conveying loop and are respectively designed to convey and deliver an article of dispatch.

23. An arrangement according to claim 22, wherein the conveying elements are conveying bins from which the articles for dispatch can be dropped at the delivery locations.

24. An arrangement for distributing articles for dispatch comprising:

a distributing conveyor having a number of conveying elements that circulate one after another along a conveying route and are respectively designed to convey and deliver articles for dispatch;

collecting containers that are arranged at delivery locations along the conveying route, said conveying elements of said distributing conveyor being conveyor bins from which the articles for dispatch can be dropped into the collecting containers;

a control device determining the respective delivery locations for the articles for dispatch and emitting transfer signals that identify the respective delivery locations; and a transfer device movable along a movement route that leads to the delivery locations and responding to the transfer signals emitted by the control device in order to automatically and selectively transfer collecting containers between the delivery locations designated by the transfer signals and a predetermined transporting route for the collecting containers.

* * * * *